United States Patent [19]

Richards

[11] Patent Number: 4,518,636

[45] Date of Patent: May 21, 1985

[54] SELECTIVE PLATING

[75] Inventor: Michael A. Richards, Delapre, England

[73] Assignee: S. G. Owen Limited, Northampton, England

[21] Appl. No.: 538,657

[22] Filed: Oct. 3, 1983

[30] Foreign Application Priority Data

Oct. 5, 1982 [GB] United Kingdom ..... 8228378

[51] Int. Cl.[3] ..... C25D 5/02

[52] U.S. Cl. ..... 427/282; 427/124; 427/125; 427/287; 427/300; 427/328; 118/301; 204/15; 204/206; 204/207; 204/224 R

[58] Field of Search ..... 427/124, 125, 282, 287, 427/300, 328; 118/721, 301; 204/15, 206, 207, 224 R

[56] References Cited

U.S. PATENT DOCUMENTS

| | | | |
|---|---|---|---|
| 3,257,308 | 6/1966 | Cottom | 204/297 W |
| 3,616,305 | 10/1971 | Arbez | 204/53 |
| 3,835,017 | 9/1974 | Mentone et al. | 204/15 |
| 3,974,056 | 8/1976 | Jogwick | 204/15 |
| 4,374,004 | 2/1983 | Salama | 204/15 |
| 4,414,075 | 11/1983 | Cockeram | 204/224 R |

FOREIGN PATENT DOCUMENTS

| | | |
|---|---|---|
| 1396342 | 6/1975 | United Kingdom . |
| 1458922 | 12/1976 | United Kingdom . |
| 1549862 | 8/1979 | United Kingdom . |

*Primary Examiner*—Richard Bueker
*Attorney, Agent, or Firm*—Spencer & Frank

[57] ABSTRACT

A method of selective plating a component, which method includes contacting upper and lower faces of the component with upper and lower masks, respectively, so that the lower mask exposes a part of the component to be plated, positioning the component over a plating tank and selective plating the component with a plating medium, the plating pressure and the hardness of the material of the upper mask being such that the upper mask is deformed during plating so as at least partially to mask the edge(s) of the exposed part.

9 Claims, 3 Drawing Figures

SELECTIVE PLATING

BACKGROUND OF THE INVENTION

The invention relates to selective plating, in particular the selective plating of components such as connectors with electrodepositable metals and alloys such as gold.

In a previously proposed method for the selective plating of connectors with gold, a plurality of connectors make up a reel which is indexed in plating heads sliding on tracks over a plating tank, each plating head comprising means, for example a lower mask, for exposing a selected portion of each connector to electrolyte and a resilient backing member for releasably sealing the rear of the reel during plating. An elongate slot jet locates between the tracks. An apparatus for carrying out the method is described and illustrated in U.S. patent application Ser. No. 06/333,692 (Cockeram), now U.S. Pat. No. 4,414,075.

Other methods have also been previously proposed for plating onto a contact face using top and bottom masks. However, previously proposed methods have suffered from the disadvantage that the edges of the components being plated remain unmasked and are therefore plated unnecessarily. The metal deposited on the component edges can comprise about 30% of the total weight of metal plated (depending on the shape of the component) and is not required for functional purposes. Large amounts of gold (or other metal) are thus wasted.

SUMMARY OF THE INVENTION

It is an object of the present invention to enable the provision of a method of selective plating whereby the above disadvantage may be overcome or at least mitigated.

Accordingly, the present invention provides a method of selective plating a component, wherein at least part of at least one edge of the component is masked, as well as a component whenever plated using the method and a mask for use in the method. Preferably, the mask is a deformable elastic upper mask, which deforms under pressure so as to protrude between adjacent components during plating and thus at least partially mask the exposed edges thereof. Advantageously, the deformable upper mask comprises a silicone rubber having a hardness of from 12° to 20° shore, more preferably from 15° to 20° shore, although a harder silicone rubber can be used and partial edge masking can be obtained at 30° to 40° shore. A typical plating pressure is about 60 psi ($4.1\times10^5$ N/m$^2$) and complete edge masking can be obtained using a silicone rubber upper mask of hardness 15° to 20° shore and a plating pressure of 60 psi ($4.1\times10^5$ N/m$^2$). Of course, other deformable materials could be used instead of the silicone rubber. Previously proposed upper masks have a hardness of from 30° to 50° shore and are not capable of distortion to produce edge masking at normal pressures.

In a preferred aspect, the present invention provides a method of selective plating a component, which method comprises contacting upper and lower faces of the component with upper and lower masks, respectively, so that the lower mask exposes a part of the component to be plated, positioning the component over a plating tank and selective plating the component, the plating pressure and the hardness of the material comprising the upper mask being such that the upper mask is deformed during plating so as at least partially to mask the edge(s) of the said exposed part.

The method of the present invention may be used in any suitable selective plating machine, such as the machine described above for selective plating components on a reel on the "Carousel" type selective plating machine of S. G. Owen Limited, which is in commercial use in the United Kingdom and the United States of America. The upper, deformable, mask may be clamped pneumatically, hydraulically or mechanically against the anode pressure. Apart from the edge masking of the present invention, plating is effected in the conventional manner, utilizing, for example, an appropriate one of the commercially available plating solutions. A suitable current density for gold plating connectors in the "Carousel" type selective plating machine is about 20 amp/dm$^2$ (2000 amp/m$^2$) of cathode interface.

The method of the present invention can be used to plate with any electrodepositable metal or alloy. However, it is envisaged that the method will be of particular utility in plating with relatively expensive metals such as gold, silver, ruthenium and palladium. Taking, as an example, the 206D connector as specified by British Telecom or the 946 range of connectors of the Western Electric Co. in the United States of America, and assuming a current market of 180 million units per annum, it is estimated that a cost saving in gold of about U.S. $ 33 million could be achieved in a year (gold at U.S. $ 414 per Troy oz) by using edge masking. It has been found that the method of the present invention can also give rise to a favourable thickness distribution in the plating medium, so that, in the above example, there is a potential further saving of about U.S. $ 3 million to U.S. $ 5 million.

Furthermore, it has hitherto been thought that failing to plate the edges of a component such as a connector, even when not strictly necessary to the function of the component, could have an adverse effect on component performance because of the formation of corrosion products on the edges. The inventor in respect of the present invention has now made the surprising discovery that this is not, in fact, the case, at least when plating open form connectors with gold, for some applications.

Thus, the present invention enables material cost savings to be achieved without reducing the performance of the component to be plated.

DESCRIPTION OF PREFERRED EMBODIMENT

Figure 1:
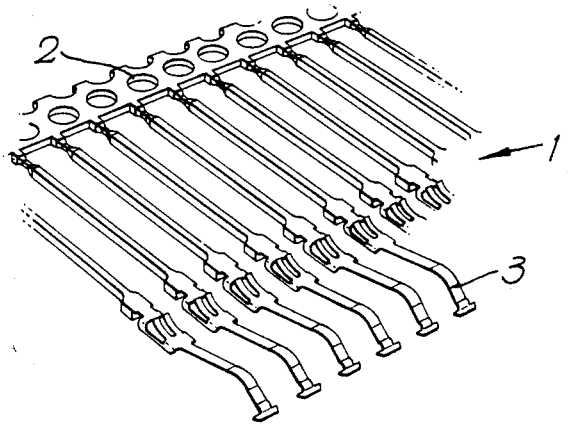
FIG. 1 is a perspective view of connectors to be plated.
Figure 2:
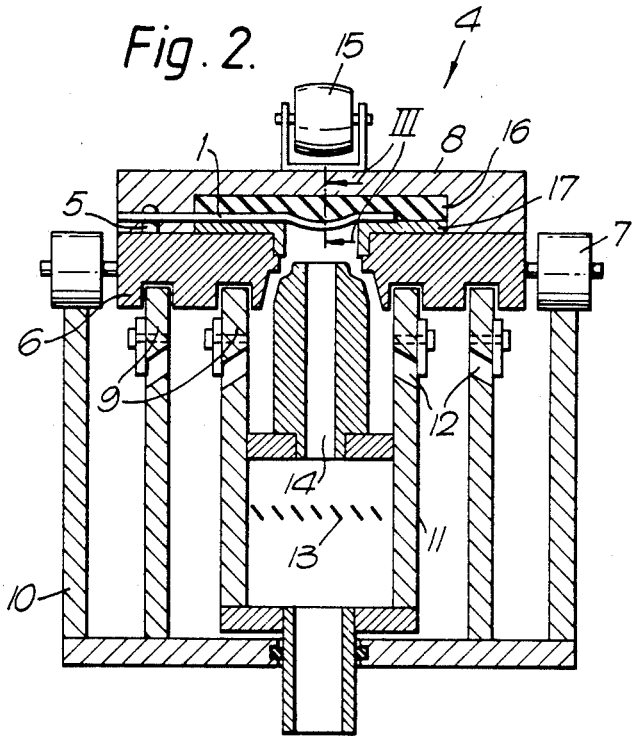
FIG. 2 is a vertical sectional view of a plating head having the connectors of FIG. 1 indexed therein.

Referring now to the drawings, connectors 1 are joined to form a reel having sprocket holes 2. A portion 3 of one face of each connector is to be selective plated with gold. The reel is indexed in a plating head 4 by means of pins 5 of the plating head 4 which locate in the sprocket holes 2. The plating head 4 comprises track lines 6, rollers 7 and a spring loaded lid 8 which is biased into the open position. The track lines 6 and rollers 7 ride on tracks 9 and walls 10, respectively, of a plating tank 11 which also comprises wiers 12, an anode 13 and an elongate slot jet 14. As the plating head 4 enters the plating zone the lid 8 is closed by means of a roller 15 mounted thereon so as to grip the connectors 1 between an upper, deformable, mask 16 and a lower, more rigid, mask 17. The upper deformable mask 16 is mounted in the underside of the lid 8 and comprises an elongate member of silicone rubber having a hardness of 15° to 20° shore and a normally rectangular cross-section. The lower mask 17 is mounted between the track lines 6 and comprises a silicone rubber or plastics material of 70° to 80° shore. The lower mask 17 presents a selected length of each connector 1 to the elongate slot jet 14 during plating (which is carried out with the plating head 4 stationary), while the upper mask 16 masks the upper face and the edges of each connector 1. This is because the upper mask 16 deforms under pressure so as to protrude between the connectors 1, as can more clearly be seen in FIG. 3.

Figure 3:
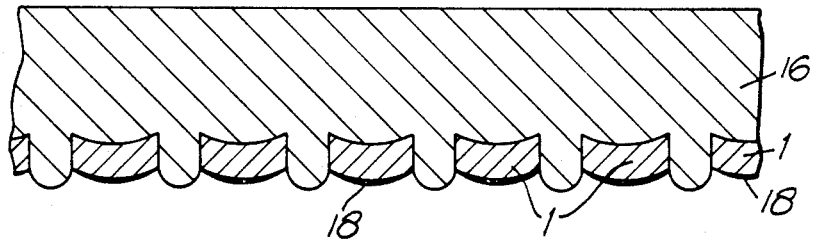
FIG. 3 is a sectional view taken on the line III—III of FIG. 2.

Referring now to FIGS. 3 in more detail, it can also be seen that distortion of the upper mask 16 under pressure leads to a more favorable thickness distribution in the plating medium 18—in this case gold. Thus, precious metal thickness will be achieved at the defined points, with the minimum excess elsewhere, normally towards the edge of the contact face. The thickness of the electrodeposited gold layer is typically 3 $\mu$m.

Although particular embodiments of the invention have been described and illustrated herein, it is recognized that modifications may readily occur to those skilled in the art and consequently it is intended that the following claims be interpreted to cover such modifications and equivalents.

What is claimed is:

1. A method of selective plating a component having a front face and a rear face, which method comprises: engaging the rear face of the component with a deformable mask, engaging the front face of the component with a plating mask having a plating aperture so as to expose part of the component to be plated, said exposed part being disposed within the plating aperture, deforming the deformable mask so as to at least partially mask an edge of said exposed part by contacting the edge with the deformable mask, and selective plating said exposed part of the component.

2. A method according to claim 1, wherein the step of engaging the rear of face the component is accomplished by engaging the rear face of the component with a deformable mask comprising silicone rubber.

3. A method according to claim 1, wherein the step of engaging the rear face of the component comprises engaging the rear face of the component with a deformable mask having a hardness of from 12° to 40° shore.

4. A method according to claim 3, wherein the step of engaging the rear face of the component with a deformable mask having a hardness of from 12° to 40° shore is accomplished by engaging the component with a deformable mask having a hardness of from 12° to 20° shore.

5. A method according to claim 3, wherein the said step of engaging the rear face of the component with a deformable mask having a hardness of from 12° to 40° shore is accomplished by engaging the component with a deformable mask having a hardness of from 15° to 20° shore.

6. A method according to claim 1, wherein the step of deforming the deformable mask is accomplished by applying a pressure of about 60 psi ($4.1\times10^5$ N/m$^2$) to the mask to deform the same.

7. A method according to claim 1, wherein the step of selective plating said exposed part of the component is accomplished by selective plating the component with gold.

8. A method according to claim 1, wherein the component is a connector.

9. A method of selective plating a component, which method comprises contacting upper and lower faces of the component with upper and lower masks, respectively, said lower mask having a plating aperture to expose a part of the component to be plated, positioning the part of the component exposed by the plating aperture over a plating tank, and selective plating the exposed part of the component, the plating pressure and the hardness of the material comprising the upper mask being such that the upper mask is deformed at the plating aperture during plating so as at least partially to mask an edge of the said exposed part.

* * * * *